US007533732B2

(12) United States Patent
Boyd

(10) Patent No.: US 7,533,732 B2
(45) Date of Patent: May 19, 2009

(54) DUAL ENTRY APPARATUS FOR A SUBTERRANEAN BOREHOLE

(75) Inventor: Mark Dwayne Boyd, Lake Charles, LA (US)

(73) Assignee: Smith International, Inc., Houston, TX (US)

( * ) Notice: Subject to any disclaimer, the term of this patent is extended or adjusted under 35 U.S.C. 154(b) by 171 days.

(21) Appl. No.: 11/327,922

(22) Filed: Jan. 9, 2006

(65) Prior Publication Data

US 2007/0158078 A1 Jul. 12, 2007

(51) Int. Cl.
*E21B 19/00* (2006.01)

(52) U.S. Cl. ..... 166/385; 166/379; 166/77.1; 166/242.5

(58) Field of Classification Search ..... 166/385, 166/379, 77.1, 77.2, 242.5
See application file for complete search history.

(56) References Cited

U.S. PATENT DOCUMENTS 3,887,158 A * 6/1975 Polk ..... 251/1.1
4,399,877 A 8/1983 Jackson et al.
4,506,729 A * 3/1985 Davis et al. ..... 166/66.5
4,681,162 A 7/1987 Boyd
RE33,150 E 1/1990 Boyd
5,284,210 A 2/1994 Helms et al.
5,778,978 A * 7/1998 Crow ..... 166/254.2
5,803,191 A 9/1998 Mackintosh
6,202,764 B1 3/2001 Ables et al.
6,269,879 B1 8/2001 Boyd
6,367,553 B1 4/2002 Boyd
6,520,262 B2 * 2/2003 Barnett et al. ..... 166/367
6,732,805 B1 * 5/2004 Boyd ..... 166/379

* cited by examiner

*Primary Examiner*—David J Bagnell
*Assistant Examiner*—Sean D Andrish

(57) ABSTRACT

A borehole entry apparatus is disclosed. The apparatus includes a dual entry apparatus for use in borehole entry applications, such as slick line and/or wireline (electric wireline) applications. Exemplary embodiments of this invention enable first and second borehole entry apparatuses, such as slick line and wireline tool assemblies, to be simultaneously coupled to a well head. Use of the invention tends to advantageously save rig time and thus reduce the cost of slick line and wireline operations, in particular on a deep-water offshore drilling rig.

3 Claims, 6 Drawing Sheets

DUAL ENTRY APPARATUS FOR A SUBTERRANEAN BOREHOLE

FIELD OF THE INVENTION

The present invention relates generally to slick line and/or wireline tool applications in a subterranean borehole. More particularly, this invention relates to an above-hole, dual-entry apparatus for use in slick line and/or wireline tool applications.

BACKGROUND OF THE INVENTION

The use of various downhole tools in the drilling and evaluation of subterranean oil and gas wells is well known and conventional in the art. Many such tools are run into open and/or cased boreholes using conventional slick line and/or wireline arrangements. For example, a conventional mechanical calliper (or gauge) tool is often lowered into and pulled out of the borehole using a steel cable (slick line). Conventional wireline logging tools, on the other hand, are typically run into the borehole using a wireline that includes both power and electronic data lines coupled, for example, to an uphole power source and computer network. In typical drilling and/or borehole evaluation applications, slick line and wireline tools are often utilized sequentially. For example, it is not uncommon, to utilize a slick line tool (such as a calliper tool) to first measure borehole gauge and then to utilize one or more wireline logging tools to log a portion of the borehole.

It will be appreciated that the term "wireline" is sometimes used in the art to refer to both conventional slick line and electric wireline (which is also referred to as e-line). As used herein, the term "slick line" refers to conventional cabling (e.g., a conventional steel wire or cable) that does not include electric lines (neither power nor electronic data lines). Slick line tends to be more robust and less expensive than electric wireline and is therefore often used in applications that do not require electrical or electronic communication with the surface. The term "wireline" is used herein to refer to electric wireline (e-line). A conventional wireline includes a plurality of electrical conductors (e.g., power and data lines) located, for example, at the core of a wound or braided steel cable. Wireline is more expensive than slick line and is therefore typically only used with downhole tools that require electric power and/or electronic communication with the surface.

It is common oilfield practice to mount the slick line or wireline tool assemblies and pressure control equipment directly to the wellhead (e.g., to a blow-out-preventor at the rig floor), thereby enabling the downhole tools to be lowered directly into the borehole. For example, in exemplary slick line tool applications, a slick line tool assembly (e.g., including a stuffing box) is coupled to the upper end of a pressure control string, which is coupled to the blow out preventor at the rig floor. In exemplary wireline tool applications, a wireline tool assembly (e.g., including a grease injection head and/or a packoff box) is coupled to the upper end of the pressure control string. When changing from a slick line tool to a wireline tool (or from a wireline tool to a slick line tool), the pressure control string is typically disconnected from the blow out preventor, positioned horizontally on the rig floor, and the slick line tool assembly replaced with a wireline tool assembly (or visa versa). The pressure control string, including the wireline tool assembly, is then lifted into position above the blow out preventor and reconnected thereto. It is not uncommon for this procedure to require several hours of rig time. Such rig time is expensive, especially in deep-water, offshore operations, in which the cost of the rig may sometimes exceed $10,000 per hour.

Therefore there exists a need for an apparatus that reduces the time required to assemble and disassemble slick line and wireline tooling configurations. In particular, an apparatus that permits alternate use of slick line and wireline tools without the necessity of intervening assembly and disassembly procedures would be particularly advantageous.

SUMMARY OF THE INVENTION

The present invention addresses one or more of the above-described drawbacks of the prior art. Aspects of this invention include a dual entry apparatus for use in borehole entry applications, such as slick line and/or wireline (electric wireline) applications. Exemplary embodiments of this invention enable first and second borehole entry apparatuses, such as slick line and wireline tool assemblies, to be simultaneously coupled to a well head via, for example, a conventional blow out preventor. In one exemplary embodiment, the apparatus includes first and second legs deployed on an upper end of a tool body. A slick line tool assembly (e.g., including a stuffing box) may be coupled to the first leg and a wireline tool assembly (e.g., including a grease injection head) coupled to the second leg. The lower end of the tool body is configured for connecting to a pipe string (e.g., a conventional lubricator deployed above the well head). The apparatus further includes first and second valves deployed in the corresponding legs.

Exemplary embodiments of the present invention may advantageously provide several technical advantages. For example, when using exemplary embodiments of this invention it is typically not necessary to make and break the connections between the slick line and wireline tool assemblies and the lubricator when replacing a slick line tool with a wireline tool (or visa versa). This tends to save rig time and thus reduce the cost of slick line and wireline operations, in particular on a deep-water offshore drilling rig.

In one aspect the present invention includes a borehole entry apparatus. The apparatus includes a tool body having an upper end and a lower end and first and second tubular legs deployed on the upper end of the tool body. A first upper passageway extends through the first leg into the upper end of the tool body. The first upper passageway includes a first valve deployed therein, which is disposed to selectively open and close the first passageway. A second upper passageway extends through the second leg into the upper end of the tool body. The second upper passageway includes a second valve deployed therein, which is disposed to selectively open and close the second passageway. The first and second upper passageways merge together into a single lower passageway that extends through the lower end of the tool body.

In another aspect this invention includes a method for removing a first downhole tool from a borehole and replacing it in the borehole with a second downhole tool. The method includes providing a borehole entry apparatus including a tool body having first and second upper passageways in an upper portion thereof. The first and second passageways merge into a single lower passageway in a lower portion of the tool body. The borehole entry apparatus further includes first and second valves disposed to selectively open and close the first and second passageways. The first downhole tool is deployed in the borehole and connected to a cable routed through the first passageway, while the second downhole tool is connectable to a second cable routed through the second passageway. The method further includes retracting the first downhole tool out of the borehole, disconnecting the first downhole tool from the first cable, closing the first valve, opening the second valve, connecting the second downhole tool to the second cable, and lowering the second downhole tool into the borehole.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
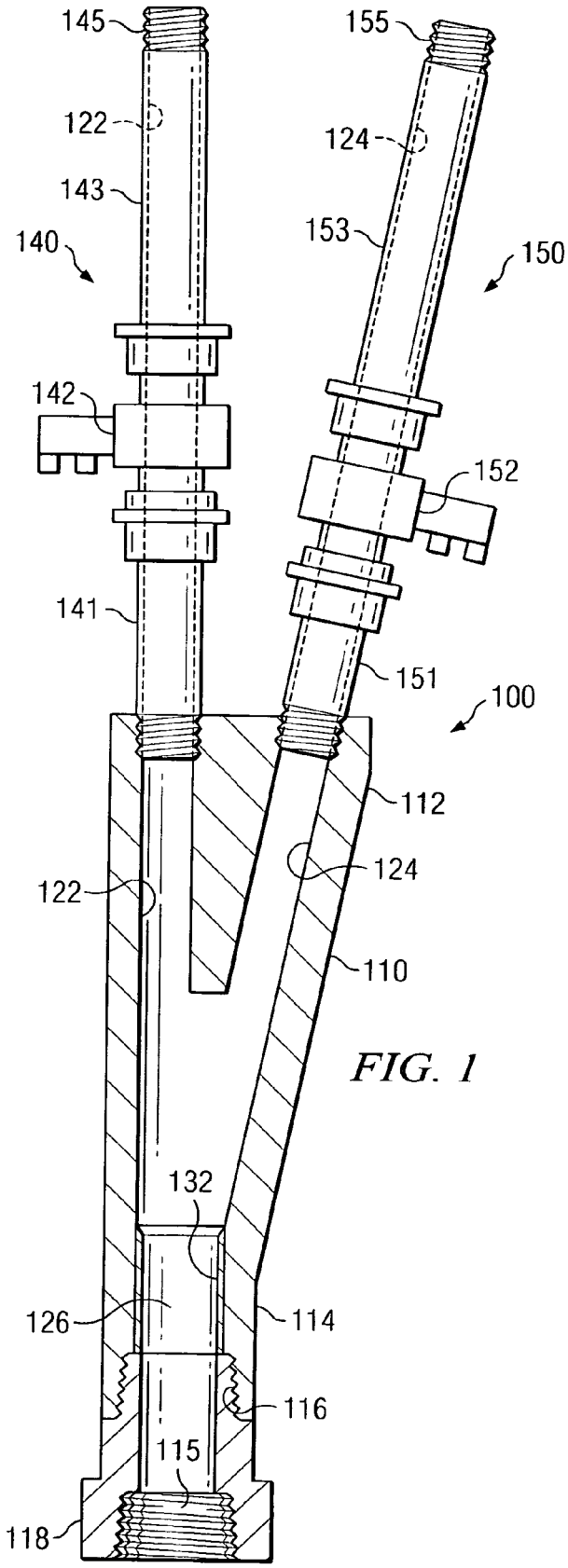
FIG. 1 depicts one exemplary embodiment of a dual entry sub according to this invention.

Referring to FIGS. 1, 3, 4, and 6, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1, 3, 4, and 6 may be described herein with respect to that reference numeral shown on other views.

Referring now to FIG. 1, one exemplary embodiment of a dual entry apparatus 100 according to this invention is illustrated. Dual entry apparatus 100 includes a pair of upper passageways 122 and 124 that extend through an upper portion 112 of tool body 110 and merge into a single lower passageway 126 that extends through a lower portion 114 of the tool body 110. The upper passageways 122 and 124 extend upwards into leg portions 140 and 150. Each of the leg portions includes a valve 142, 152 (such as a hydraulic plug valve) deployed in a length of pipe. As described in more detail below, the valves 142 and 152 are intended to selectively open and close the upper passageways 122 and 124, thereby enabling a weight bar, for example, coupled to slick line or wireline, to be extended and retracted through the tool body 110. The tool body 110 includes a lower connector 115 (e.g., a conventional Otis or Bowen connector) for coupling to a pipe string. Each of the legs 140 and 150 includes a corresponding upper connector 145 and 155 for coupling to a borehole entry apparatus, such as a conventional slick line or wireline tool assembly (e.g., as described in more detail below, one leg typically includes a conventional Otis-type connector for connecting to a slick line tool assembly while the other leg typically includes a conventional Bowen-type connector for connecting to a wireline tool assembly).

In the exemplary embodiment shown on FIG. 1, the tool body 110 includes a side entry sub, such as the fly out, medium, or long boy side entry subs available from Boyd's Rental Tools (Lake Charles, La.). In such embodiments, upper passageway 122 is substantially parallel with but radially offset from lower passageway 126. In one exemplary embodiment, upper passageway 124 angles radially outward from upper passageway 126 at an angle of about 3.5 degrees, however the invention is not limited in this regard. Passageways 122, 124 and 126 may be equivalently angled and offset relative to one another in substantially any suitable manner such that sufficient physical space is provided for valves 142 and 152 to be deployed in corresponding leg portions 140 and 150.

Figure 2A:
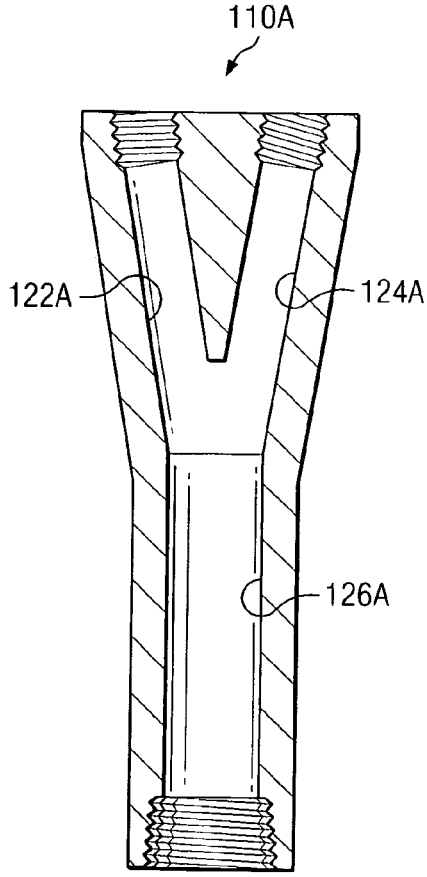
FIGS. 2A through 2C depict alternative embodiments of a tool body portion of a dual entry sub according to this invention.
Figure 2B:
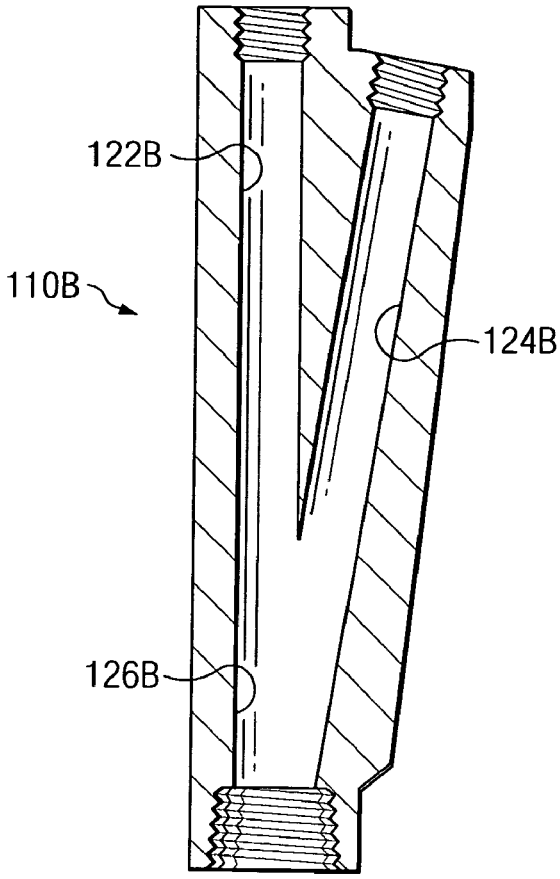
Figure 2C:
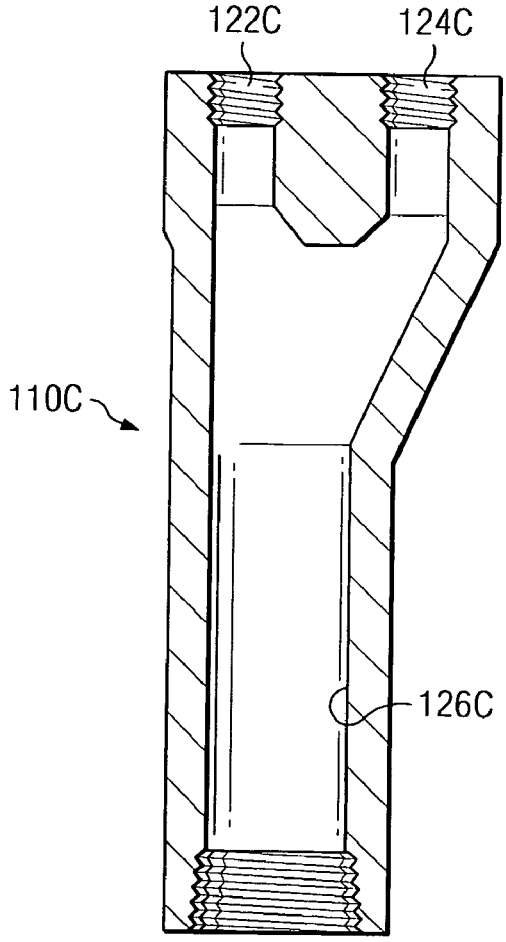

With reference now to FIGS. 2A through 2C, alterative embodiments 110A-C of exemplary tool bodies suitable for use in this invention are illustrated. Tool bodies 110A-C are similar to tool body 110 in that they include first and second upper passageways 122A-C and 124A-C joined with a single lower passageway 126A-C. In FIG. 2A, upper passageways 122A and 124A both angle radially outward from lower passageway 126A in a Y-shaped configuration. In FIGS. 2B and 2C, upper passageways 122B and 122C are coaxial with corresponding lower passageways 126B and 126C. In FIG. 2B, upper passageway 124B angles radially outward from passageways 122B and 126B. In FIG. 2C, upper passageway 124C is substantially parallel with but radially offset from passageways 122C and 126C. It will be appreciated that the invention is not limited in these regards and that embodiments 110A-C are merely exemplary and shown for illustrative purposes only.

With reference again to FIG. 1, exemplary embodiments of tool body 100 include a threaded box end 116 on the lower portion 114 thereof. An adapter sub 118, including lower connector 115 (e.g., including a convention Otis or Bowen connector as described above), is coupled to the box end 116 of the tool body 110 as shown. It will be appreciated that the invention is also not limited in these regards. The lower connector 115 may include substantially any type of connector arrangement suitable for connecting to a pipe string. Moreover, the connector 115 may be formed directly on the tool body 110 (rather than in adapter sub 118). In the exemplary embodiment shown, lower passageway 126 includes a removable wear sleeve 132 deployed therein. The wear sleeve 132 is preferably fabricated from a hardened material (such as a hardened steel) and is intended to minimize wear to the tool body from contact with the slick line and/or wireline. Braided wireline, in particular, is known to cause wear.

With continued reference to FIG. 1, exemplary leg portions 140 and 150 each include first sections 141 and 151 and second sections 143 and 153 sections of pipe deployed about the valves 142 and 152. As stated above, substantially any suitable valve may be utilized, provided that the valve opens sufficiently wide enough to allow a conventional weight bar (e.g., as shown on FIG. 3) to be lowered and retracted therethrough. In the exemplary embodiment shown, valves 142 and 152 include hydraulic plug valves, such as Part Number VC0463 available from Dixie Iron Works, Inc. (Alice, Tex.). In the exemplary embodiment shown, leg portion 150 includes a conventional Bowen-type connector 155 deployed at the upper end of pipe section 153, e.g., for coupling to a wireline tool assembly (as shown on FIG. 3), while leg portion 140 includes a conventional Otis-type connector 145 deployed at the upper end of pipe section 143, e.g., for coupling to a slick line tool assembly (as shown on FIG. 3). However the invention is not limited in these regards.

Figure 3:
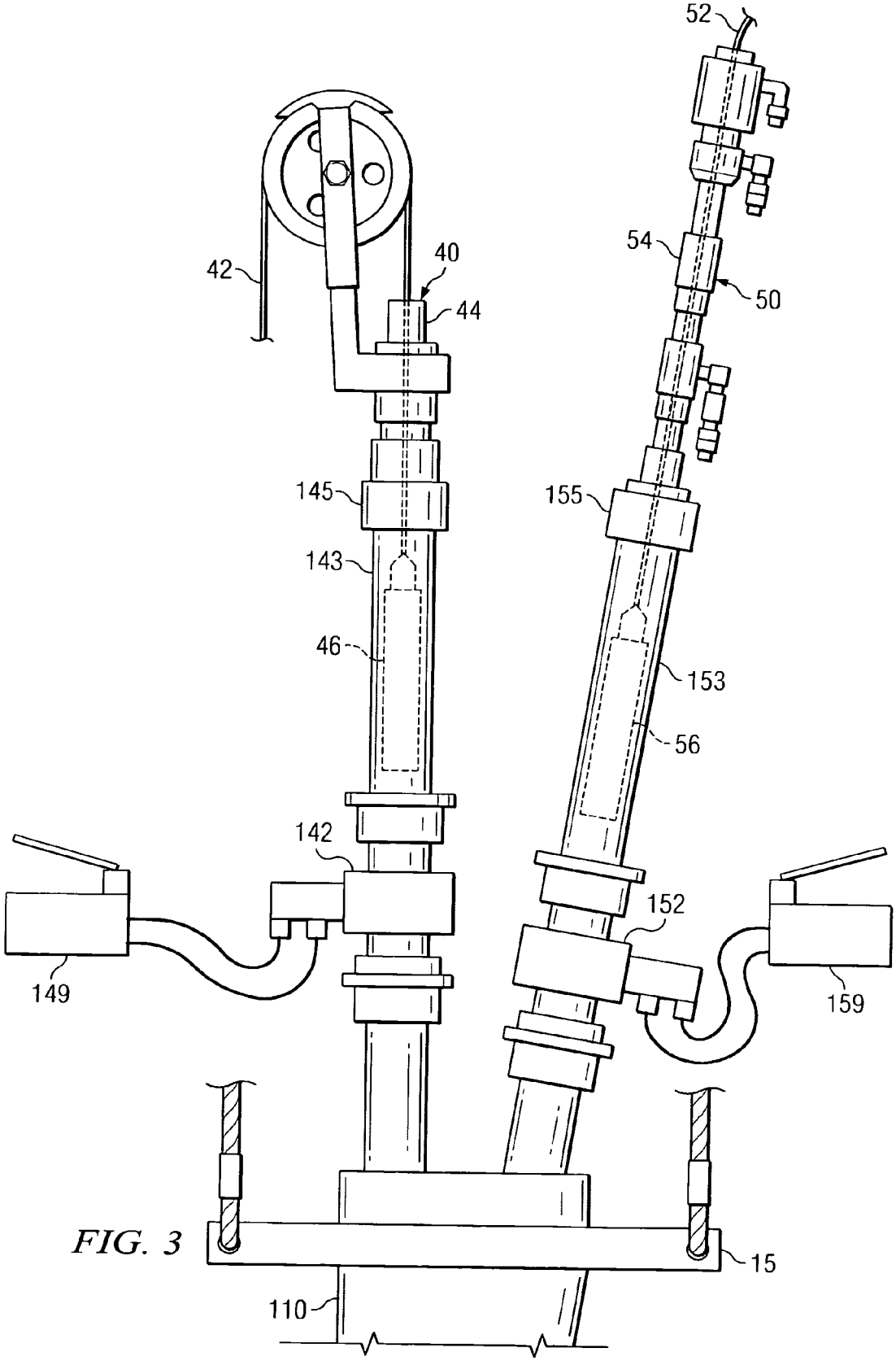
FIG. 3 depicts exemplary wireline and slick line tool assemblies coupled to an upper end of the dual entry sub shown on FIG. 1.
Figure 4:
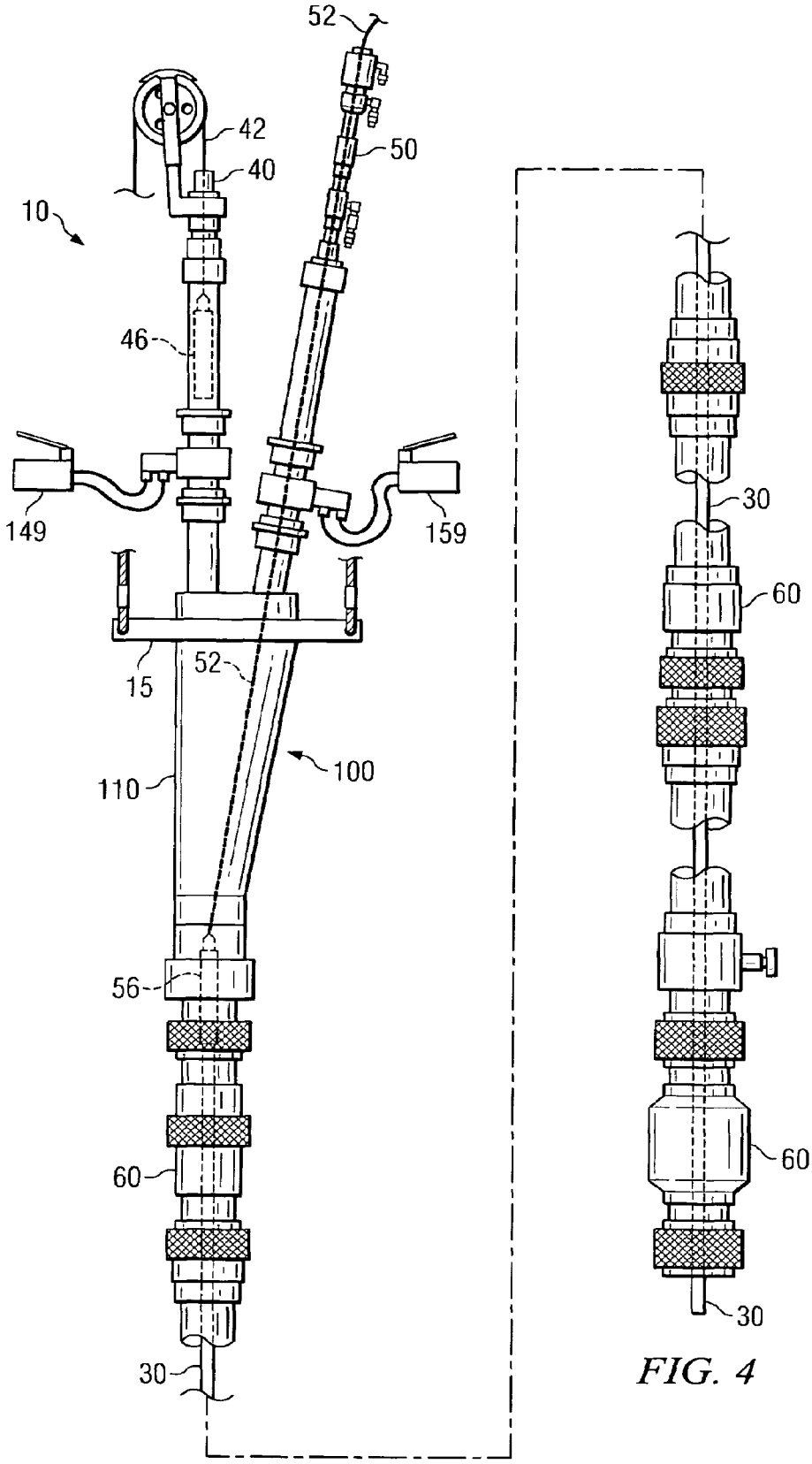
FIG. 4 depicts an exemplary pipe string arrangement including the dual entry sub shown on FIG. 1.

With reference now to FIGS. 3 and 4, dual entry apparatus 100 is shown in use. In FIG. 3, exemplary slick line 40 and wireline 50 assemblies are shown coupled to leg portions 140 and 150 of dual entry apparatus 100. In the exemplary embodiment shown, slick line tool assembly 40 includes a slick line 42 routed through a sealing apparatus 44 such as a conventional stuffing box available from Boyd's Rental Tools. Wireline tool assembly 50 includes a wireline 52 (e.g., including a braided cable having a plurality of electrical conductors therein) routed through a sealing apparatus 54 such as a conventional grease injection head, also available from Boyd's Rental Tools. It will be appreciated that the invention is not limited in these regards and may be used with substantially any suitable slick line and/or wireline tooling configurations, for example, including a hydraulic packoff box or substantially any other suitable sealing arrangements, including manual, hydraulic, and/or pneumatic arrangements.

While dual entry apparatus 100 is shown coupled to exemplary slick line 40 and wireline 50 assemblies in FIGS. 3 and 4, it will be appreciated that the invention is further not limited in this regard. For example, dual entry apparatus 100 may also be deployed in combination with first and second slick line or first and second wireline tool assemblies. In such applications, it may be advantageous to replace a slick line tool with another slick line tool (or a wireline tool with another wireline tool), for example, requiring a different type or size of cable. Moreover, dual entry apparatus 100 is not limited to use with slick line and wireline tool assemblies, but may be deployed in combination with substantially any suitable borehole entry apparatus.

With continued reference to FIGS. 3 and 4, conventional weight bars 46 and 56 are shown coupled to the ends of the slick line 42 and wireline 52. The weight bars 46 and 56 are further shown deployed above valves 142 and 152 in corresponding pipe sections 143 and 153. In the exemplary embodiment shown on FIG. 3, pipe sections 143 and 153 have sufficient length (e.g., greater than about 2 feet) to house the weight bars 46 and 56 above the valves 142 and 152. In such a configuration, the valves 142 and 152 are typically closed, thereby isolating the slick line 40 and wireline 50 assemblies from the lower portion of the tool 100. As described in more detail below, one of the valves 142 and 152 may be opened during use, thereby enabling slick line 42 or wireline 52 to be lowered through the tool 100.

It will be appreciated that valves 142 and 152 advantageously enable one or more of the slick line 40 and wireline 50 assemblies to be selectively isolated from the borehole environment in use. In this manner additional pressure containment capabilities (e.g., high pressure grease equipment) are advantageously not required. For example, in an exemplary embodiment in which a slick line tool (not shown) is deployed in a borehole, valve 142 is opened allowing the tool to be lowered and raised in the borehole (via slick line 42). In such an embodiment, valve 152 is typically closed, thereby isolating wireline assembly 50 (or another slick line assembly) from the borehole. As such it is not necessary to contain the borehole pressure at both the slick line 40 and wireline 50 assemblies.

While the embodiment shown on FIGS. 3 and 4 includes hydraulic actuators 149 and 159 coupled to valves 142 and 152, it will be appreciated that the invention is not limited in this regard. Valves 142 and 152 may include substantially any type of suitable valve utilizing substantially any actuating mechanism, including, for example, hydraulic, pneumatic, and manual actuation.

Referring now also to FIG. 4, a pipe string 10 including dual entry apparatus 100 is shown suspended (e.g., above the rig floor) on a conventional spreader bar 15 deployed about tool body 110 of dual entry apparatus 100. As described above, conventional slick line 40 and wireline 50 tool assemblies are shown coupled to the upper end of the dual entry apparatus 100. The pipe string 10 also includes a conventional pressurized lubricator 60 (e.g., available from Boyd's Rental Tools) coupled to the lower end of the dual entry apparatus 100. Weight bar 56 (FIG. 3) is coupled to the upper end of a wireline tool 30 (e.g., an electric wireline logging tool, which, as shown, is partially drawn up into the lubricator 60.

As stated above, the use of dual entry apparatus 100 tends to advantageously reduce the time required to remove a first downhole tool (e.g., a slick line tool) from a borehole and deploy a second downhole tool (e.g., a wireline tool) in the borehole, by simplifying the assembly and disassembly procedures. In particular, embodiments of this invention enable downhole tools (e.g., slick line and wireline tools) to be quickly and efficiently interchanged in the borehole. As will be appreciated by those of ordinary skill in the art, efficient interchanging of such tools conserves rig time and therefore advantageously reduces the expense of slick line and wireline operations (especially in offshore applications and in particular in deep water applications).

Figure 5:
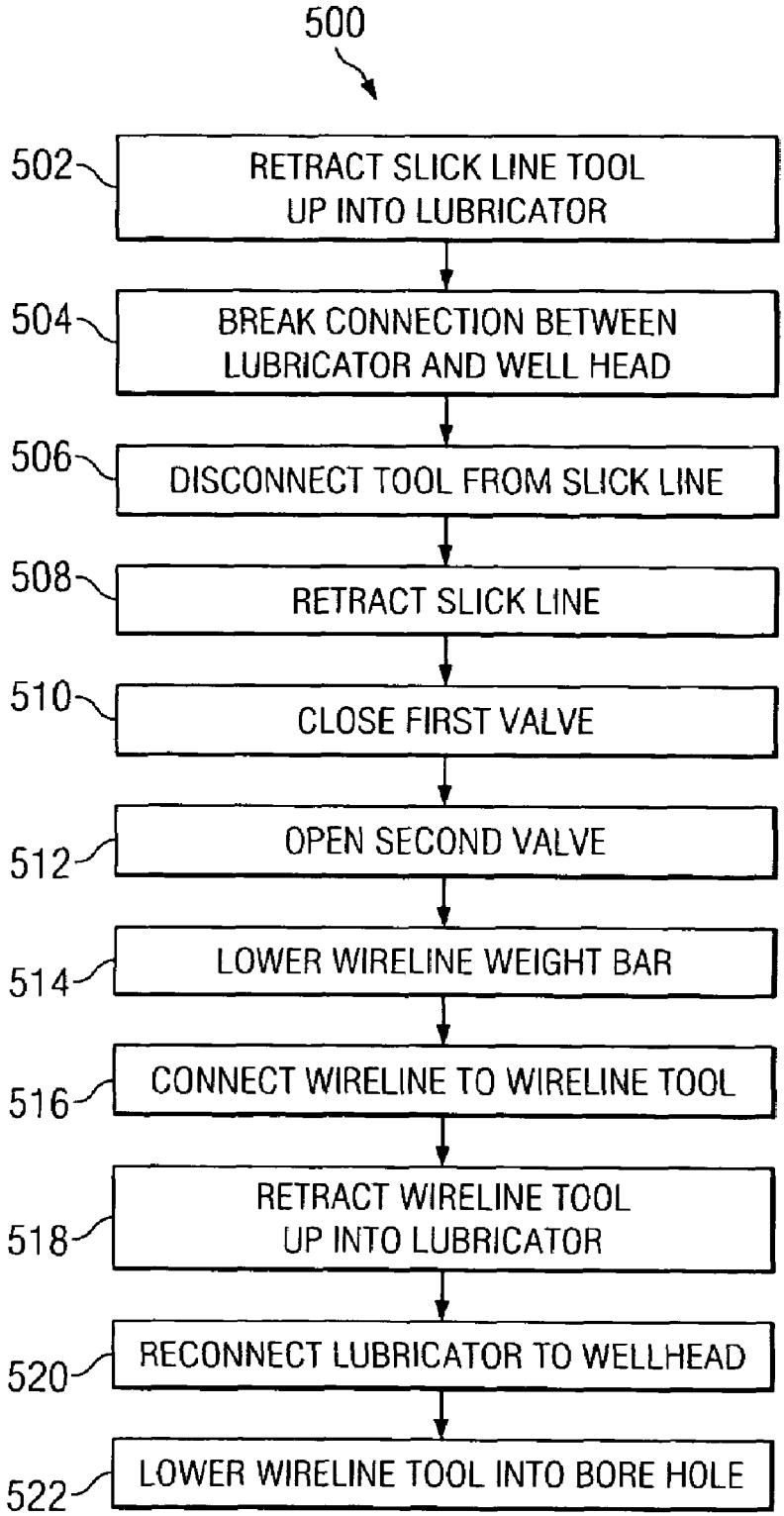
FIG. 5 depicts a flow diagram of one exemplary method embodiment of this invention.
Figure 6:
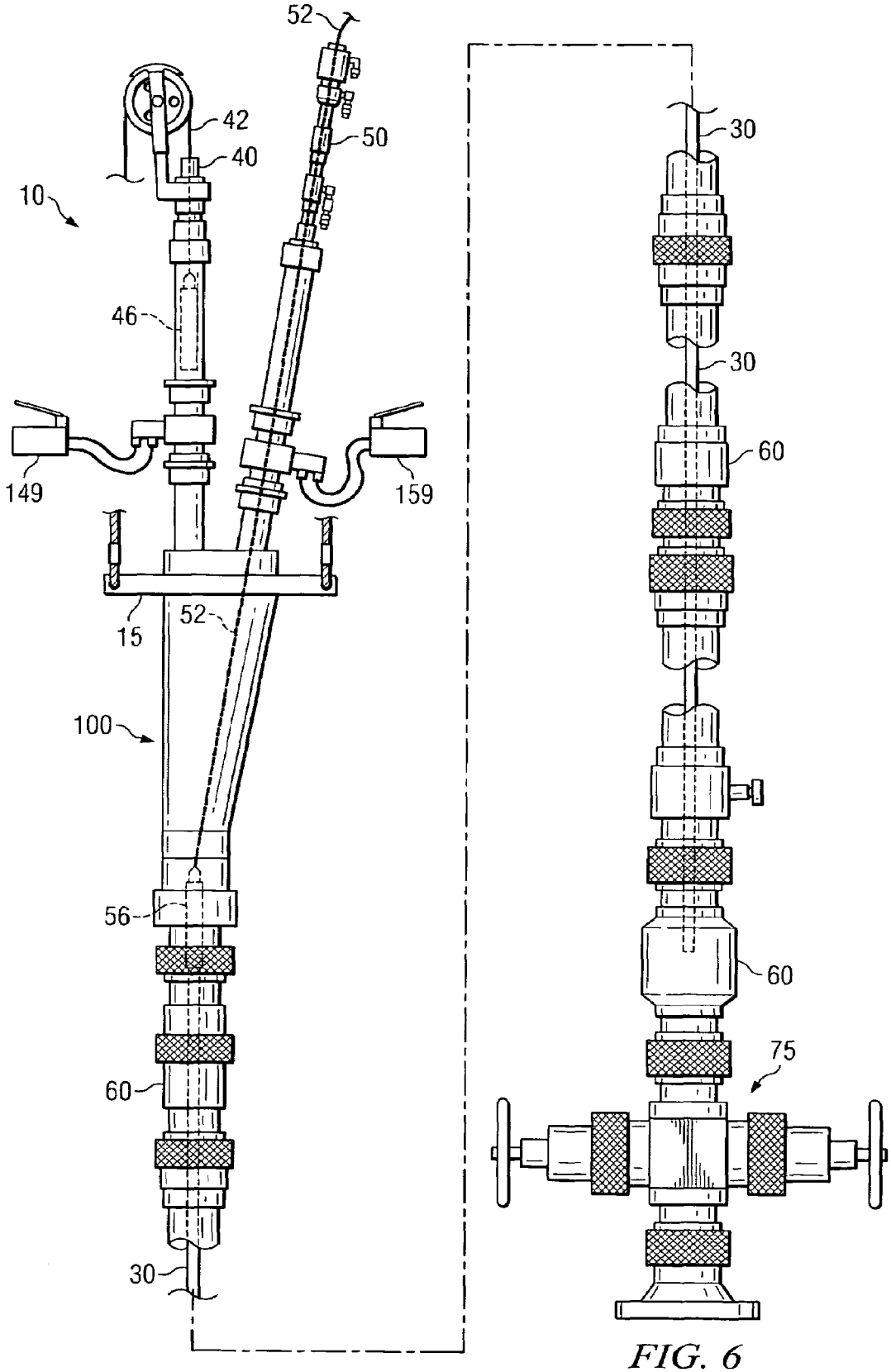
FIG. 6 depicts the pipe string arrangement shown on FIG. 4 connected to an exemplary blow out preventor, e.g., at a drilling rig floor.

With reference now to FIG. 5, the following exemplary method 500 may be Utilized, for example, to remove a slick line tool from a borehole and deploy a wireline tool Therein. It will be appreciated that a similar procedure may be utilized to remove a wireline tool from the borehole and deploy a slick line tool therein, to replace a slick line tool with another slick line tool, or to replace a wireline tool with another wireline tool. At step 502 a slick line tool (not shown on FIGS. 4 and 6) is retracted into lubricator 60. After sealing the borehole (e.g., closing the blow out preventor 75 shown on FIG. 6) and depressurizing the lubricator 60, the connection between the lubricator 60 and well head (e.g., blow out preventor 75) may be broken at step 504. At step 506 the slick line cool (not shown) is lowered out of the lubricator 60 (e.g., to the rig floor) and removed and disconnected from the slick line weight bar 46. The slick line 42 may then be retracted at step 508 such that weight bar 46 is positioned above valve 142 in pipe section 143. At step 510 valve 142 is closed thereby advantageously isolating the slick line assembly 40 from the borehole environment. Valve 152 is then opened at step 512. Weight bar 56 may then be lowered to the rig floor at step 514 and connected to the wireline tool 30 at step 516. At step 518, the wireline tool 30 is retracted upwards into the lubricator 60. After pressurizing the lubricator 60, the pipe string 10 is reconnected to the wellhead (e.g., to a blow out preventor 75 at the rig floor as shown on FIG. 6) at step 520. The wireline tool 30 may then he lowered into the borehole at step 522.

I claim:

1. A method for removing a first downhole tool from a borehole and replacing it in the borehole with a second downhole tool, the method comprising:

(a) providing a borehole entry apparatus including a tool body having first and second upper passageways in an upper portion thereof, the first and second passageways merging into a single lower passageway in a lower portion of the tool body, the borehole entry apparatus further including first and second valves disposed to selectively open and close the first and second passageways, the first downhole tool deployed in the borehole and connected to a first cable routed through the first passageway, the second downhole tool connectable to a second cable routed through the second passageway, (b) retracting the first downhole tool out of the borehole;

(c) disconnecting the first downhole tool from the first cable;

(d) retracting a first weight bar above the first valve, the first weight bar being connected to an end of the first cable;

(e) closing the first valve after said retracting in (d);

(f) opening the second valve;

(g) lowering a second weight bar below the second valve, the second weight bar being connected to an end of the second cable;

(h) connecting the second downhole tool to the second cable after said lowering in (g); and (i) lowering the second downhole tool into the borehole.

2. The method of claim 1, wherein:

the first and second downhole tools are selected from a group consisting of slick line tools and wireline tools; and the first and second cables are selected from a group consisting of slick line and wireline.

3. The method of claim 1, wherein:

the borehole entry apparatus is deployed above a lubricator in a pipe string, the lubricator being connected with a wellhead;

(b) further comprises retracting the first downhole tool out of the borehole into the lubricator and disconnecting the lubricator from the wellhead; and (h) further comprises drawing the second downhole tool up into the lubricator and reconnecting the lubricator to the wellhead.

* * * * *